US007834732B2

(12) United States Patent
Steinberger

(10) Patent No.: US 7,834,732 B2
(45) Date of Patent: Nov. 16, 2010

(54) IGNITION COIL, IN PARTICULAR FOR AN INTERNAL COMBUSTION ENGINE OF A MOTOR VEHICLE

(75) Inventor: Werner Steinberger, Rauhenzell (DE)

(73) Assignee: Robert Bosch GmbH, Stuttgart (DE)

( * ) Notice: Subject to any disclaimer, the term of this patent is extended or adjusted under 35 U.S.C. 154(b) by 19 days.

(21) Appl. No.: 12/298,335

(22) PCT Filed: Apr. 5, 2007

(86) PCT No.: PCT/EP2007/053398

§ 371 (c)(1),
(2), (4) Date: May 7, 2009

(87) PCT Pub. No.: WO2007/125009

PCT Pub. Date: Nov. 8, 2007

(65) Prior Publication Data

US 2010/0026436 A1 Feb. 4, 2010

(30) Foreign Application Priority Data

Apr. 26, 2006 (DE) ..... 10 2006 019 296

(51) Int. Cl.
*H01F 27/02* (2006.01)
*H01F 27/24* (2006.01)

(52) U.S. Cl. ..... 336/96; 336/234; 336/90

(58) Field of Classification Search ..... 336/92, 336/96, 90, 231; 123/634, 635
See application file for complete search history.

(56) References Cited

U.S. PATENT DOCUMENTS 2,416,148 A 2/1947 Borgerd et al.
5,632,259 A * 5/1997 Konda et al. ..... 123/634
5,986,532 A * 11/1999 Kikuta et al. ..... 336/83
6,011,457 A * 1/2000 Sakamaki et al. ..... 336/96
6,025,770 A * 2/2000 Okamoto et al. ..... 336/83
6,294,973 B1 9/2001 Kimura et al.
6,308,696 B1 * 10/2001 Kondo et al. ..... 123/634

(Continued)

FOREIGN PATENT DOCUMENTS

DE 299 01 095 6/1999

(Continued)

OTHER PUBLICATIONS

International Search Report, PCT/EP2007/053398, dated Aug. 7, 2007.

*Primary Examiner*—Anh T Mai
(74) *Attorney, Agent, or Firm*—Kenyon & Kenyon LLP

(57) ABSTRACT

An ignition coil, in particular for an internal combustion engine of a motor vehicle, has an inner magnet core which is concentrically enclosed by a primary coil and a secondary coil. The inner magnet coil is made up of sheet-metal strips stacked on top of each other, the sheet-metal strips forming a substantially rectangular or square cross-section surface of the inner magnet core. At least the lower and the upper sheet-metal strips, delimiting the inner magnet core, have, at least in partial areas, a reduced width viewed in the longitudinal direction compared to the other sheet-metal strips of the inner magnet core. This makes a primary bobbin and a secondary bobbin having an enlarged corner radius and a more uniform winding density of the primary coil and the secondary coil possible.

9 Claims, 2 Drawing Sheets

U.S. PATENT DOCUMENTS

| | | | | |
|---|---|---|---|---|
| 6,353,378 | B1 * | 3/2002 | Oosuka et al. | 336/96 |
| 6,650,221 | B2 * | 11/2003 | Oosuka et al. | 336/234 |
| 6,794,974 | B2 * | 9/2004 | Widiger et al. | 336/90 |
| 2002/0057170 | A1 | 5/2002 | Skinner et al. | |

FOREIGN PATENT DOCUMENTS

| | | |
|---|---|---|
| DE | 198 19 585 | 11/1999 |
| DE | 101 36 810 | 2/2003 |
| DE | 102 48 520 | 5/2004 |
| DE | 100 14 115 | 9/2005 |
| EP | 0 859 383 | 8/1998 |
| EP | 1 026 394 | 8/2000 |
| EP | 1 225 606 | 7/2002 |
| EP | 1 288 976 | 3/2003 |
| WO | WO 91/05047 | 4/1991 |

* cited by examiner

IGNITION COIL, IN PARTICULAR FOR AN INTERNAL COMBUSTION ENGINE OF A MOTOR VEHICLE

FIELD OF THE INVENTION

The present invention relates to an ignition coil, in particular for an internal combustion engine of a motor vehicle.

BACKGROUND INFORMATION

Such an ignition coil is described in DE 100 14 115. The conventional ignition coil has an inner magnet core made up of lamellar sheet-metal strips which are stacked on top of each other. The sheet-metal strips form an overall rectangular cross-section surface. The inner magnet core is concentrically surrounded by a primary bobbin and a secondary bobbin. The shape of both the primary bobbin and the secondary bobbin is adapted to the cross-section shape of the inner magnet core, the primary bobbin and the secondary bobbin each having rounded edges along the corner areas of the inner magnet core. In addition, the spaces between the inner magnet core, the primary coil with its primary bobbin, and the secondary coil with its secondary bobbin are surrounded by an insulation compound, in particular by an insulation resin which is used for electrical insulation between the voltage-carrying components.

During manufacture of the primary coil and the secondary coil, the bobbin will be provided with a winding of the primary wire and the secondary wire, respectively. This is carried out in that the primary bobbin and the secondary bobbin are rotatably supported in their symmetry axes and, during the rotation, pull a wire off a supply spool and the appropriate windings are applied to the primary bobbin and the secondary bobbin. The geometric design of the primary bobbin and the secondary bobbin with its essentially rectangular cross-section surface having rounded edges results in different pull-off speeds of the wire during the rotation of the primary and the secondary bobbins depending on the angular position of the bobbins according to FIG. 6, curve A. This has the effect that the highest wire pull-off speeds prevail in the corner areas of the primary bobbin and the secondary bobbin, resulting in the primary wire and the secondary wire being applied to the primary bobbin and the secondary bobbin under relatively high tension. This causes a compaction of the wire layers in the corner areas of the bobbins, which makes the subsequent impregnation or insulation of the primary coil and the secondary coil with the insulation resin more difficult, since the resin is unable to properly fill the spaces between the individual wire layers. The electrical insulation capability and the breakdown capability of the ignition coil are reduced in the corner areas.

In so-called rod ignition coils, i.e., ignition coils whose coils are directly situated in a borehole of the cylinder head of the internal combustion engine, it is conventional to provide a circular cross section of the inner magnet core (EP 0 859 383). In this case, sheet-metal strips having different widths are used for the inner magnet core to make the circular cross section possible.

Furthermore, it is described in DE 299 01 095 to provide an inner magnet core in a rod ignition coil which has a substantially rectangular cross section. Only the lowermost and the uppermost strips of the sheet-metal packet each have a reduced width, the width being approximately one third to one half of the width of the remaining sheet-metal strips. This makes it possible, according to DE 299 01 095, to achieve a cross section adapted to a circular cross section. The disadvantage is that the cross-section surface of the magnet core (compared to a rectangular cross section) is reduced and the magnetic properties of the sheet-metal packet are not optimally utilized. Moreover, the problems in the corner areas of the magnet core having the increased wire pull-off speeds and the associated disadvantageous effects during winding of the primary bobbin and the secondary bobbin remain.

SUMMARY

The ignition coil, in particular for an internal combustion engine of a motor vehicle according to example embodiments of the present invention, has the advantage that, with maximum utilization of the available cross-section surface within the primary and the secondary coils and thus good magnetic properties of the inner magnet core, the local speed peaks at the primary and the secondary bobbins during winding with the appropriate wire in the corner areas are reduced. This makes less tight winding of the primary bobbin and the secondary bobbin with the primary wire and the secondary wire possible, which results in a better and more uniform impregnation and thus a better insulation of the ignition coil.

Exemplary embodiments of the present invention are illustrated in the drawings and explained in greater detail in the following.

DETAILED DESCRIPTION

Figure 1:
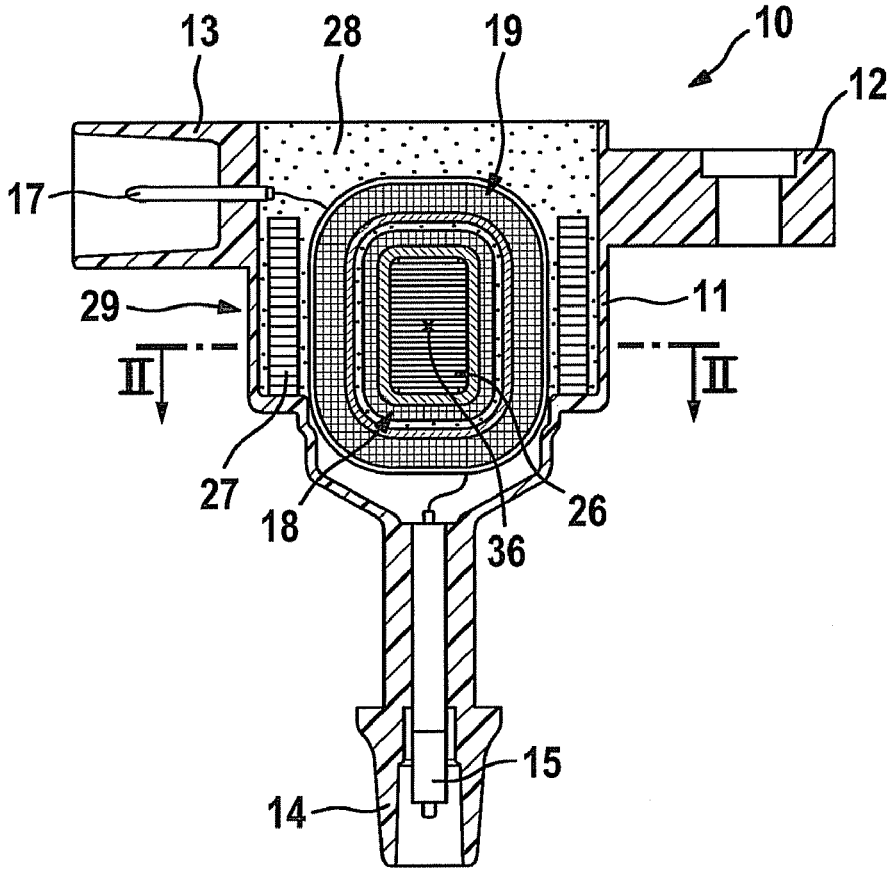
FIG. 1 shows a longitudinal section through an ignition coil according to example embodiments of the present invention.
Figure 2:
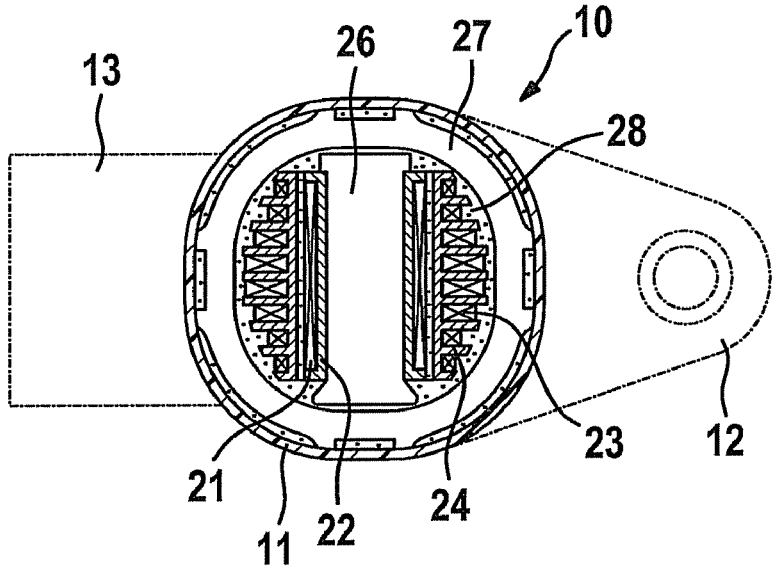
FIG. 2 shows a section in the plane II-II of FIG. 1.

Ignition coil 10 shown in FIG. 1 is designed as a so-called compact ignition coil and is used for providing the ignition voltage for a spark plug of an internal combustion engine in a motor vehicle. Ignition coil 10 has a plastic housing 11 which is connectable, for example, to the cylinder head of the internal combustion engine via a connecting flange 12 molded onto housing 11. Opposite connecting flange 12, a connector 13 is molded for contacting ignition coil 10 with the on-board voltage of the motor vehicle. In the lower area, housing 11 also has a connecting piece 14 having an integrated high-voltage pin 15 which is contactable to the spark plug of the internal combustion engine which supplies the ignition power for igniting the mixture in the cylinder head. While contact 17 in connector 13 is electrically connected to a primary coil 18, high-voltage pin 15 is electrically coupled to a secondary coil 19. Primary coil 18 has a primary winding 21 which is wound on a primary bobbin 22. Secondary coil 19 has a secondary winding 23 which is situated on a secondary bobbin 24. Primary coil 18 and secondary coil 19 concentrically enclose an inner magnet core 26.

Inner magnet core 26 is coupled to an outer magnet core 27 having a closed shape which also encloses primary coil 18 and secondary coil 19. Both magnet cores 26 and 27, as well as primary coil 18 and secondary coil 19, are situated within upper area 29 of housing 11 of ignition coil 10, the gap located between the individual components being filled with an insulation resin 28 which reaches up to the top of housing 11. Compared to a so-called rod ignition coil, the components of ignition coil 10 located in area 29 of a compact ignition coil are situated outside or above the cylinder head, while connecting piece 14, which is in contact with the spark plug via high-voltage pin 15, is preferably located inside a borehole in the cylinder head of the internal combustion engine. Ignition coil 10 described so far and whose operating mode is already known is therefore not explained in greater detail.

Figure 3:
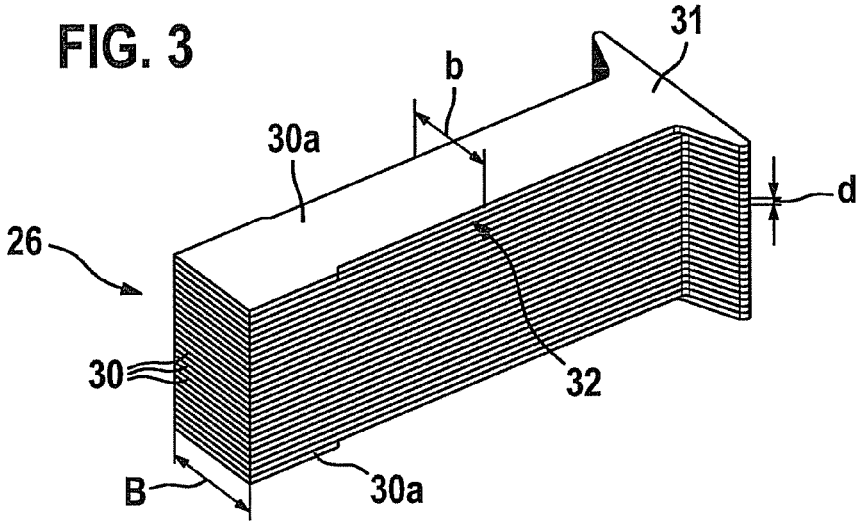
FIG. 3 shows a perspective view of the inner magnet core made up of sheet-metal strips stacked on top of each other according to FIGS. 1 and 2, FIGS. 4 and 5 show partial areas of different ignition coils according to example embodiments of the present invention in longitudinal sections in the area of the respective inner magnet core.

With reference to FIG. 3, the configuration according to example embodiments of the present invention of inner magnet core 26 is explained in greater detail in the following: It is apparent that inner magnet core 26 is made up of a plurality, e.g., ten to thirty, lamellar sheet-metal strips 30 which are stacked on top of each other and connected to each other. Magnet core 26 overall forms a cross-section surface which is rectangular (in a special case square) in cross section. Sheet-metal strips 30 all have the same thickness and are preferably manufactured in a stamping process. Furthermore, it is apparent that sheet-metal strips 30 have a substantially rectangular base, an anvil-shaped end section 31 being formed on one end of sheet-metal strips 30.

It is important that at least the uppermost and the lowermost sheet-metal strip 30*a* of magnet core 26 differ from the other sheet-metal strips 30. This difference relates at least to that section of sheet-metal strips 30, 30*a* which is essentially situated inside of primary coil 118 and secondary coil 19. While sheet-metal strips 30, with the exception of end section 31, have an essentially constant width B over their total longitudinal extension, width b of sheet-metal strips 30*a* in the area inside of primary coil 18 and secondary coil 19 is reduced by twice the thickness d of sheet-metal strips 30, 30*a*. As is apparent from FIG. 4, this creates stepped corner areas 32 along both upper longitudinal edges (and correspondingly also along both lower longitudinal edges), surfaces 33, cut out of magnet core 26 by corner areas 32, each having a square shape in cross section. These cut out surfaces 33 result in that radius r of primary bobbin 22, which encloses inner magnet core 26 in the exemplary embodiment, may turn out to be relatively large in the area of corner areas 32 while preserving an almost constant gap 34 for insulation resin 28. Since the design of secondary bobbin 24, which encloses primary bobbin 22, is adapted such that, for uniform wetting with insulation resin 28, a gap as uniformly large as possible exists between both bobbins, the respective radius in the corner areas of secondary bobbin 24 may correspondingly also turn out to be relatively large.

In the example shown in FIG. 3, the width of sheet-metal strips 30*a* outside corner areas 32 is identical to width B of sheet-metal strips 30. Furthermore, sheet-metal strips 30*a* also have end sections 31 corresponding to sheet-metal strips 30. Sheet-metal strips 30*a*, like sheet-metal strips 30, are also formed in a stamping process for which either a separate stamping tool may be used or the same used for sheet-metal strips 30 which produces the constriction in corner areas 32 in an additional stamping step.

Figure 4:
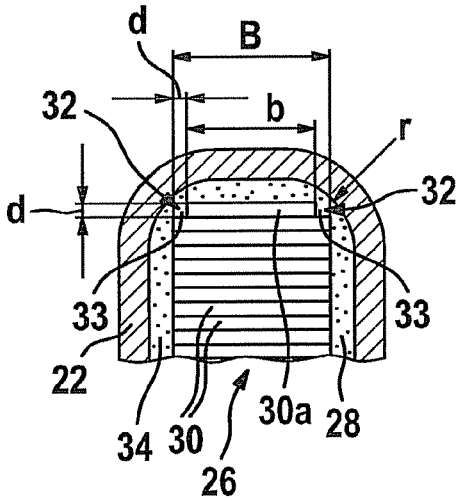
Figure 5:
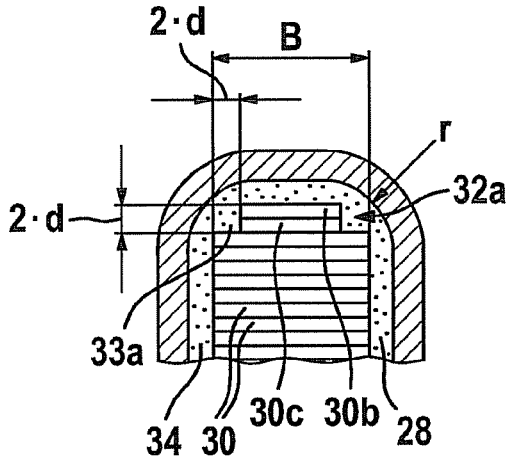

In the exemplary embodiment of the present invention shown in FIG. 5, not only the uppermost and lowermost sheet-metal strips 30*b* of inner magnet core 26*a*, but also sheet-metal strip 30*c* situated directly below sheet-metal strip 30*b*, are reduced in their width. In order to be able to also form a square-cross-section cut-out surface 33*a*, in corner areas 32*a*, the width of both sheet-metal strips 30*b* and 30*c* is reduced on both sides by twice the thickness d. Compared to the specific embodiment in FIG. 4, radius r of primary bobbin 22 may be enlarged again.

In summary, it is thus possible to cut out square surfaces in the corner areas of inner magnet core 26 since the width of the respective uppermost and lower most sheet-metal strips 30*a, b, c* is reduced in the area of primary coil 18 and secondary coil 19. The width reduction of these sheet-metal strips 30*a*, 30*b*, 30*c* opposite width B of sheet-metal strips 30 unreduced in the width results here from the number of the corresponding sheet-metal strips 30*a*, 30*b*, 30*c* multiplied by twice the thickness of one sheet-metal strip 30*a*, 30, *b*, 30*c*. Due to the square cut-out surfaces, radius r of primary bobbin 22 and secondary bobbin 24 may be enlarged in the area of the cut-out surfaces. It is taken into account that because for magnetic and functional reasons preferably the entire free cross section of primary bobbin 22 should be filled with inner magnet core 26 and, because of thermomechanical properties, a uniform (and preferably large) gap 34 for insulation resin 28 should be present. Since, on the other hand, the magnetically effective cross section of inner magnet core 26 is simultaneously reduced due to the reduced width of the upper and lower sheet-metal strips 30*a*, 30*b*, 30*c*, a compromise must be found with the simultaneously enlarged radius r on the bobbins. Therefore, the examples shown in FIGS. 4 and 5 are preferred in which only the uppermost and the lowermost or the two uppermost and lowermost sheet-metal strips 30*a*, 30*b*, 30*c* of magnet core 26 are reduced by twice the width and by four times the thickness of sheet-metal strips 30*a*, 30, *b*, 30*c*.

Figure 6:
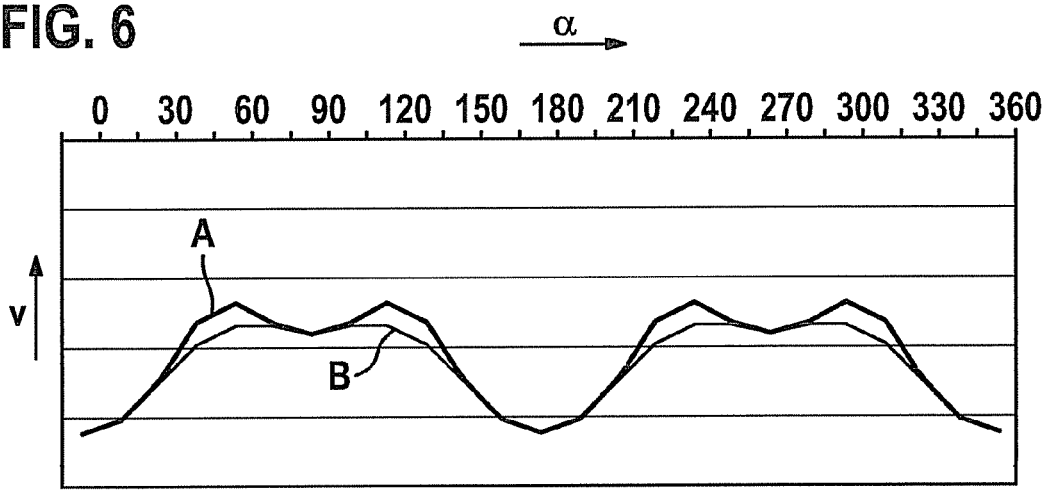
FIG. 6 shows a graphic representation of the speed curve during winding of a primary and a secondary bobbin according to conventional arrangements and according to example embodiments of the present invention.

Primary bobbin 22 and secondary bobbin 24 are wound using the wire forming primary winding 21 and secondary winding 23 in separate work steps prior to the assembly of the components in housing 11. Primary bobbin 22 and secondary bobbin 24 are rotatably supported in their longitudinal axis 36 (FIG. 1) and pull the appropriate wire off a supply spool during rotation. The speed curve over rotation angle $\alpha$ at constant rotation angle speed v of a conventional primary bobbin or secondary bobbin, without an enlarged radius r, is shown in FIG. 6 by way of curve A. It is apparent that in the four corner areas of the primary bobbin and the secondary bobbin the local speed of the wire reaches a maximum on the primary bobbin and the secondary bobbin. Curve B represents the speed curve of an inner magnet core 26, modified according to example embodiments of the present invention, having sheet-metal strips 30*a*, 30*b*, 30*c*, which makes a primary bobbin and a secondary bobbin having an enlarged radius r in the corner areas possible. It is apparent that, compared to curve A, the speed peaks present there are reduced. This results in the wire being in contact with the respective primary bobbin and secondary bobbin in the corner areas under relatively low wire tension, so that primary winding 21 and secondary winding 22 may be properly filled in the corner areas using insulation resin 28.

What is claimed is:

1. An ignition coil, comprising:

an inner magnet core which is concentrically enclosed by a primary coil having a primary bobbin and a secondary coil having a secondary bobbin, the inner magnet core formed of sheet-metal strips stacked on top of each other, the sheet-metal strips overall forming one of (a) a substantially rectangular and (b) a substantially square cross-section surface of the inner magnet core, and at least an lower and an upper sheet-metal strip, delimiting the inner magnet core, having, at least in partial areas, a reduced width compared to other sheet-metal strips of the inner magnet core viewed in a longitudinal direction of the other sheet-metal strips;

wherein at least the lower and the upper sheet-metal strips, at least in corner areas within the primary bobbin and the secondary bobbin which enclose the inner magnet core, have such a reduced width that the respective upper and lower sheet-metal strips reach into the corner areas of the inner magnet core.

2. The ignition coil according to claim 1, wherein the ignition coil is arranged as an ignition coil for an internal combustion engine of a motor vehicle.

3. The ignition coil according to claim 1, wherein a square surface is separated in the corner areas from the cross-section surface of the inner magnet core by the sheet-metal strips having a reduced width.

4. The ignition coil according to claim 1, wherein the thickness of the sheet-metal strips is identical, the width of the reduced-width sheet-metal strips is reduced by twice the thickness of the sheet-metal strips multiplied by twice a number of the upper and lower sheet-metal strips reduced in width compared to the width of the sheet-metal strips not reduced in width, and at least one of (a) an uppermost and lowermost and (b) two uppermost and lowermost sheet-metal strips of the inner magnet core are reduced in width.

5. The ignition coil according to claim 1, wherein the sheet-metal strips, reduced in their width, outside the primary bobbin and the secondary bobbin have a width and a shape identical to a width and a shape of the rest of the sheet-metal strips.

6. The ignition coil according to claim 1, wherein an area of the sheet-metal strips, reduced in width, is produced via a stamping process.

7. The ignition coil according to claim 1, wherein a gap between the inner magnet core and at least one of (a) the primary bobbin and (b) the secondary bobbin, directly enclosing the inner magnet core, is filled with at least one of (a) an insulation material and (b) an insulation resin.

8. The ignition coil according to claim 1, wherein at least one of (a) the primary bobbin and (b) the secondary bobbin, directly enclosing the inner magnet core, has, at least in the corner areas, a radius which produces an at least almost equally sized gap between the inner magnet core and at least one of (a) the primary bobbin and (b) the secondary bobbin directly enclosing the inner magnet core.

9. The ignition coil according to claim 1, wherein the ignition coil is arranged as a compact ignition coil.

* * * * *